United States Patent [19]

Tollinger et al.

[11] 4,152,856

[45] May 8, 1979

[54] TRIGGER MECHANISM

[75] Inventors: James Tollinger; Edward P. Joslyn, both of Ithaca, N.Y.

[73] Assignee: Ithaca Gun Company, Ithaca, N.Y.

[21] Appl. No.: 790,604

[22] Filed: Apr. 25, 1977

[51] Int. Cl.[2] ..... F41C 19/00

[52] U.S. Cl. ..... 42/69 B

[58] Field of Search ..... 42/69 B, 69 A, 69 R, 42/17, 16

[56] References Cited

U.S. PATENT DOCUMENTS

| | | | |
|---|---|---|---|
| 2,675,638 | 4/1954 | Crittendon | 42/69 B |
| 2,829,563 | 4/1958 | Butler | 42/69 A |
| 2,855,716 | 10/1958 | Campbell | 42/69 B |
| 2,922,241 | 1/1960 | Brunelle | 42/69 B |
| 3,011,282 | 12/1961 | Sefried | 42/69 B |

*Primary Examiner*—Charles T. Jordan

*Attorney, Agent, or Firm*—Brumbaugh, Graves, Donohue & Raymond

[57] ABSTRACT

As described herein, a trigger mechanism for a semi-automatic shotgun includes a sear adapted to hold the hammer of the mechanism in a cocked position and a displaceable trigger bar adapted to drive the sear away from the hammer upon actuation of the trigger of the mechanism. A plurality of internal teeth are formed in one end of the trigger and one of the teeth is engaged by a splined eccentric bushing that couples the trigger bar to the trigger. The lateral displacement of the trigger bar is determined by the mating between the splined eccentric bushing and the teeth of the trigger.

5 Claims, 6 Drawing Figures

TRIGGER MECHANISM

BACKGROUND OF THE INVENTION

This invention relates to trigger mechanisms for firearms of the semi-automatic shotgun and rifle type and, more particularly, to a new and improved trigger mechanism having a trigger response that may be adjusted during assembly and during use to provide accuracy of performance over the life of the firearm.

In semi-automatic shotguns, the rearward motion of an action assembly is effective to cock the hammer of the trigger mechanism. Generally, a sear is used to hold the hammer in a cocked position. The trigger mechanism also includes a trigger and trigger bar, the trigger bar functioning to drive the sear away from the hammer in response to the actuation of the trigger.

In the manufacture of such shotguns, the trigger bar and sear are calibrated so as to provide an engagement between these parts that should insure a sharp trigger response. However, because of normal manufacturing tolerances, this engagement will vary from sharp to loose. This looseness is described as trigger "take-up". Also, after extended use, a "further looseness" will develop in the engagement between the trigger bar and the sear with the result that the same trigger take-up occurs. This is undesirable from the user's standpoint since the accuracy of his shooting depends in large measure on the responsiveness of the trigger; the sharper the trigger response the more accurate the marksmanship.

Accordingly, it is an object of this invention to provide a new and improved trigger mechanism for firearms which overcomes the above-mentioned disadvantages of prior art trigger mechanisms.

It is a further object of the present invention to provide a trigger mechanism for firearms having a trigger response that may be adjusted during assembly and during the operation of the mechanism to provide an accuracy of perforemance over the life of the firearm.

SUMMARY OF THE INVENTION

These and other objects of the present invention are accomplished by a trigger mechanism for firearms having a sear adapted to hold the hammer of the mechanism in a cocked position and a displaceable trigger bar adapted to engage the sear and drive the sear away from the hammer upon actuation of the trigger of the mechanism. A coupling for the trigger and trigger bar provides a plurality of fixed areas of engagement between the trigger and the trigger bar to vary the lateral displacement of the trigger bar and thereby provide an adjustably constant pressure between the sear and the trigger bar.

In a preferred embodiment, internal grooves are formed in the trigger and the trigger and trigger bar are coupled together by a splined eccentric bushing. The key of the bushing is engageable with any one of the grooves to vary the displacement of the trigger bar.

DESCRIPTION OF THE PREFERRED EMBODIMENT

Figure 1:
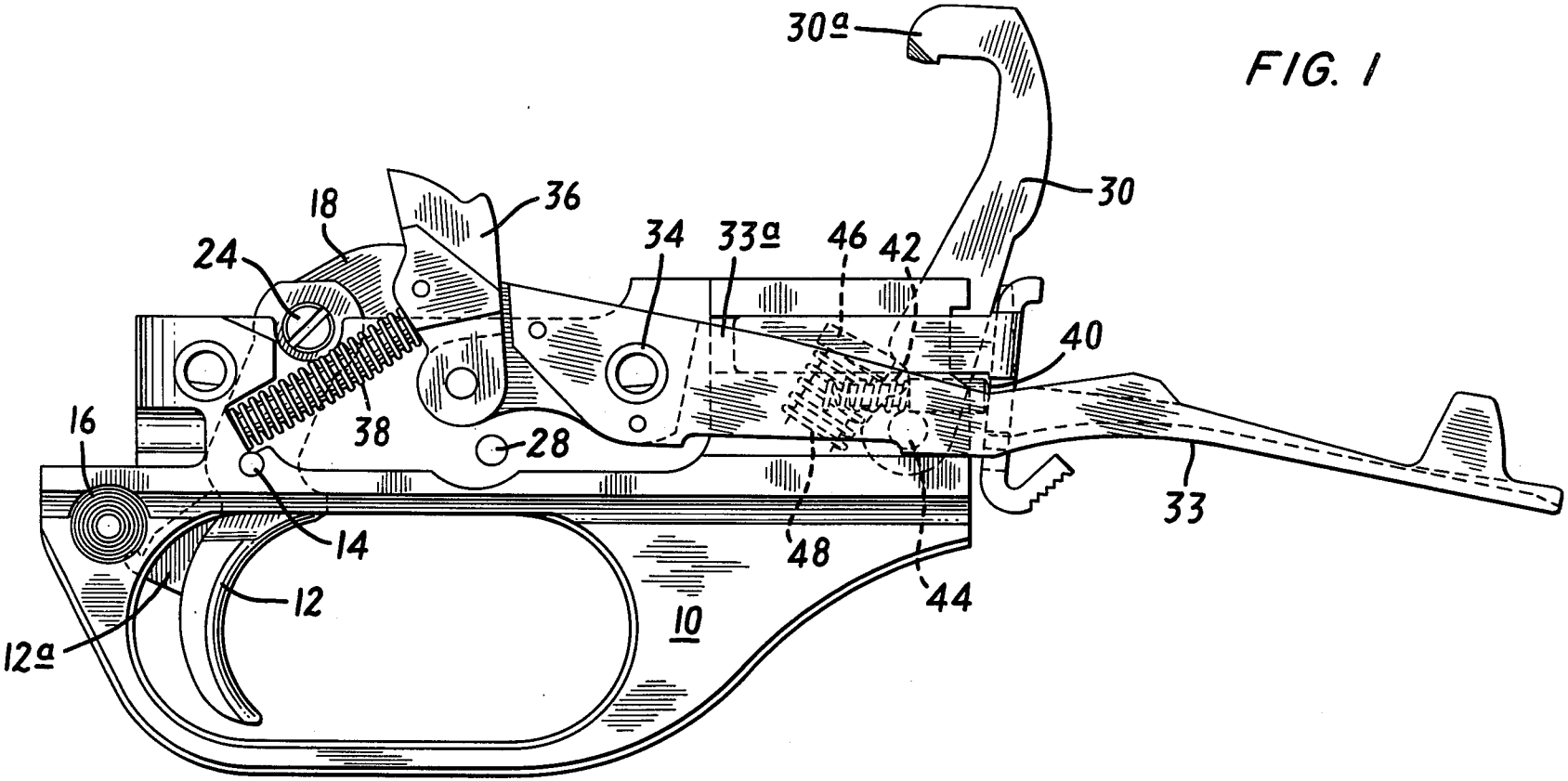
FIG. 1 is a side view of an illustrative trigger mechanism arranged according to the present invention.
Figure 3:
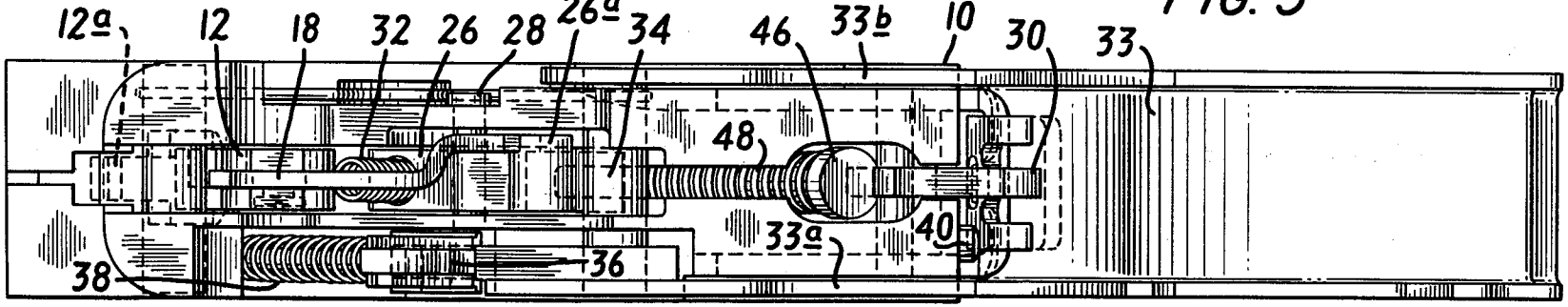
FIG. 3 is a top plan view of the trigger mechanism shown in FIG. 1.

As shown in the drawings, the trigger assembly of this invention comprises a trigger plate 10 within which a trigger 12 is pivotally mounted on a pin 14. The trigger 12 includes a safety tang **12*a* that abuts a spring-biased safety pin 16. Preferably, the safety hole is machined in assembly after the trigger 12 and the hammer and sear (described hereinafter) are connected to the trigger plate. Specifically, with elements assembled, the safety hole of the trigger plate (0.313"/0.316" diameter) is milled and reamed. The result is that the end of the tang 12*a* is milled off and no clearance will exist between the tang 12*a* and the safety pin 16** after the pin is inserted.

Figure 6:
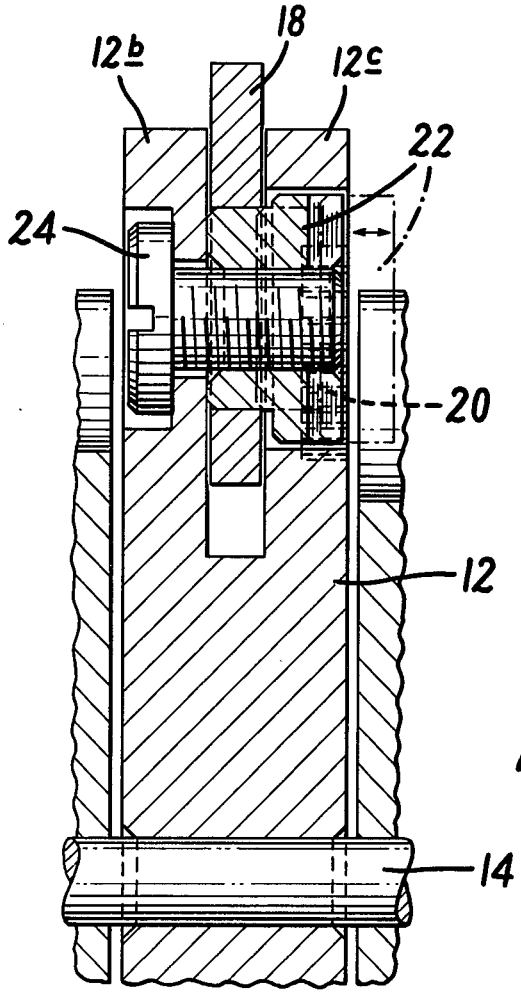
FIG. 6 is a sectional view of the trigger mechanism taken along line 6—6 of FIG. 2.

In accordance with the present invention, the upper end of the trigger is slotted to receive a trigger bar 18. The legs **12*b* and 12*c* of the trigger 12 defining the slot include aligned openings, with the leg 12*c* on the right-hand side of the trigger (as viewed in FIG. 6) also including serrations or teeth 20 formed in the leg on diametrically opposite side of the opening. An internally threaded splined eccentric bushing 22 is slidable within the opening formed in the leg 12*c* and the corresponding opening formed in the trigger bar 18. It includes a key 22*a* that may be rotated into engagement with any one of the teeth 20 to adjust the lateral displacement of the trigger bar 18. A threaded locking screw 24 draws the bushing 22 against the leg 12*b* to lock the bushing in place and fix the displacement of the trigger bar 18**.

Figure 2:
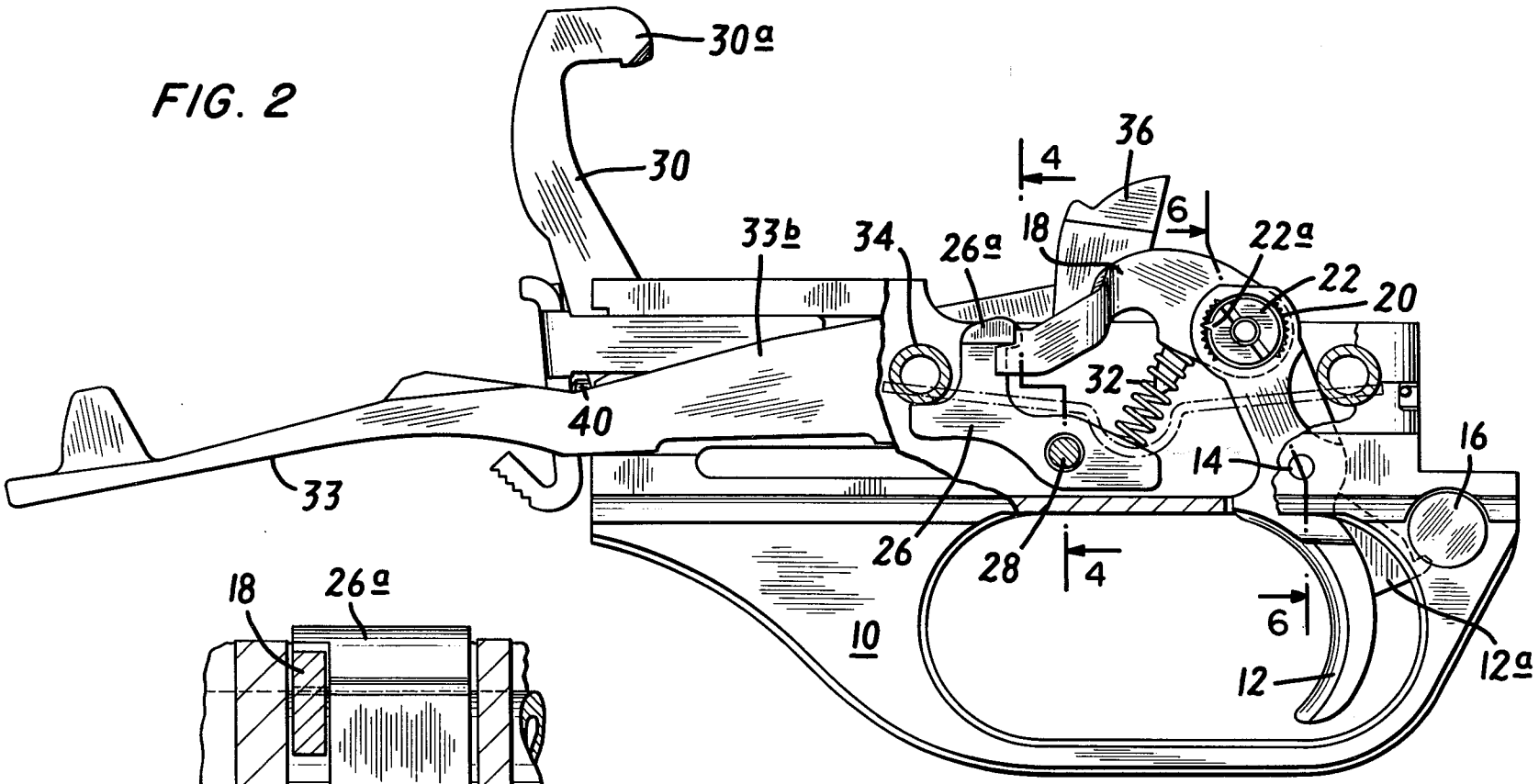
FIG. 2 is another side view, partly broken away, of the illustrative trigger mechanism arranged according to the present invention.
Figure 4:
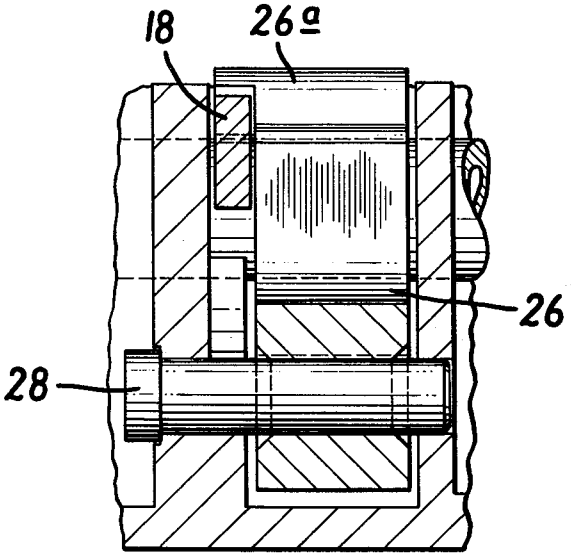
FIG. 4 is a sectional view of the trigger mechanism taken along line 4—4 of FIG. 2 and looking in the direction of the arrows.
Figure 5:
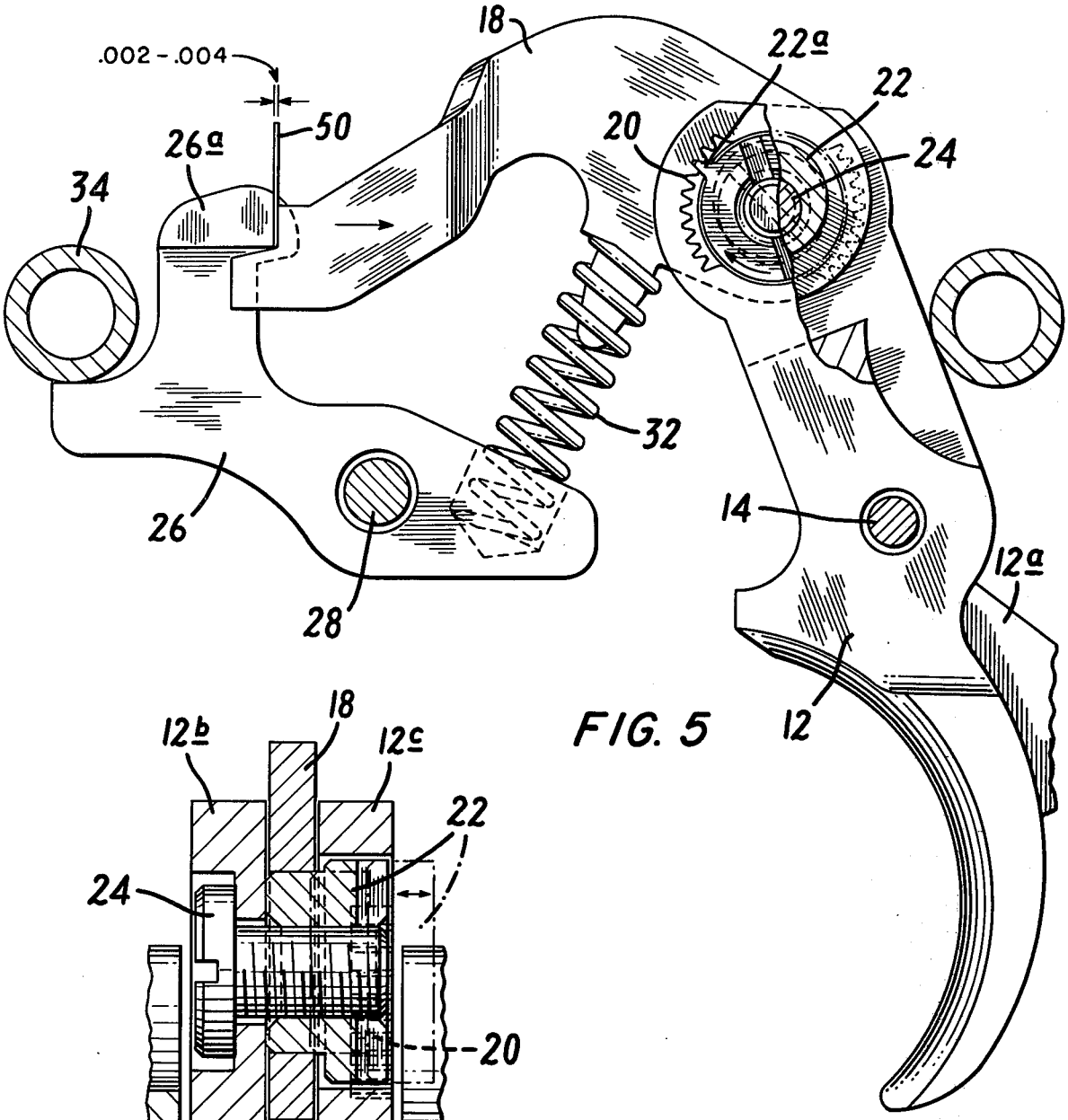
FIG. 5 is an enlarged view of the trigger, trigger bar and sear of the illustrative trigger mechanism.

As best shown in FIGS. 2, 4, and 5, the other end of the trigger bar engages a sear 26 which is pivotally mounted on a pivot pin 28 mounted in the trigger plate 10. A protruding edge **26*a* of the sear engages the lateral arm 30*a* of a hammer 30 to hold the hammer in a cocked position in response to the rearward motion of the action assembly (not shown) of the firearm. A sear spring 32 extends between a protrusion formed on the underside of the trigger bar 18 and the sear 26. In this manner, the sear 26 is biased to hold the hammer in place and to return to its locking position after it has been driven away from the hammer 30 by the trigger bar 18**.

The remaining components of the trigger mechanism are a vertically movable carrier 33 with arms **33*a* and 33*b* supported by and pivotable about a carrier pin 34. A pivotal carrier cam 36 abuts the leg 33*a* of the carrier 33. As the result of pressure exerted against the cam 36 by a carrier spring 38, the cam urges the carrier 33 downwardly into a cartridge receiving position. Also included are a carrier release plunger 40 and a carrier release sping 42**.

Finally, the mechanism includes a hammer pivot 44, a hammer plunger 46 and a hammer spring 48. Cocking of the hammer by the action assembly occurs against the biasing of the hammer in an upright position and, by the same token, when the hammer is released, the hammer is driven to its upright position to fire the chambered cartridge.

In the operation of the trigger mechanism of the present invention, firing is accomplished by squeezing the trigger 12 to thereby drive the trigger bar 18 into the sear 26. Th sear is rotated away from its engagement with the hammer 30 and the hammer is released. When the action assembly cocks the hammer, it also pivots the trigger bar 18 about the eccentric bushing 22 in a downward motion that disengages the action bar from the sear 26. The sear spring 32 then returns the sear 26 to the load position even though the trigger 12 may be in the pulled position. Upon forward movement of the action assembly, the sear spring 32 returns the trigger bar 18 into the engagement position with sear 26 upon relaxation of the trigger 12.

Trigger take-up can occur in assembly because of manufacturing tolerances or can occur after extensive use. The present invention provides for immediate correction. This is accomplished by loosening the pivot locking screw 24 and sliding the splined eccentric bushing 22 away from its engagement with the leg **12*c* of the trigger. The eccentric bushing 22 is rotated until a gap occurs between the trigger bar 18 and the sear 26. A shim 50 having a thickness between 0.002" to 0.004" (FIG. 5) is inserted into the gap, and the eccentric bushing 22 is adjusted until the trigger bar 18 abuts the shim 50. The key 22*a* of the bushing is then pushed into the closest matching groove formed in the leg 12*c* of the trigger. The pivot locking screw 24 is then tightened to lock the bushing in place and maintain the correct spacing between the trigger bar 18 and the sear 26**.

It will be understood that the above-described embodiment is merely exemplary and that those skilled in the art may make many variations and modifications without departing from the spirit and scope of the invention. All such modifications and variations are intended to be within the scope of the invention as defined in the appended claims.

We claim:

1. A trigger mechanism for firearms comprising a hammer, a sear adapted to hold the hammer in a cocked position, a trigger, a trigger bar adapted to engage and drive the sear away from the hammer, and coupling means secured to the trigger bar for engaging the trigger at different radial locations to thereby control the lateral displacement of the trigger bar and its engagement with the sear.

2. A trigger mechanism according to claim 1 wherein the trigger is provided with a plurality of radially-spaced receptacles and the coupling means comprises and eccentric bushing having a key element engageable with any one of the receptacles to provide the necessary displacement of the trigger bar.

3. A trigger mechanism according to claim 2 wherein the trigger is slotted to receive the trigger bar and includes grooves formed in one of the legs defining the slot and the eccentric bushing is slidable to permit the engagement of its key element with any one of the grooves formed in the leg of the trigger.

4. A trigger mechanism according to claim 3 further comprising a locking screw adapted to draw the eccentric bushing against the other leg of the trigger defining the slot to thereby lock the bushing in place.

5. A trigger mechanism for firearms comprising a hammer, a sear adapted to hold the hammer in a cocked position, a trigger, a trigger bar adapted to engage and drive the sear away from the hammer, and coupling means secured to the trigger bar for engaging the trigger at any of a plurality of spaced locations to vary the displacement of the trigger bar with respect to the sear.

* * * * *